US005189338A

United States Patent [19]

Ohishi et al.

[11] Patent Number: 5,189,338

[45] Date of Patent: Feb. 23, 1993

[54] PHOTOMULTIPLIER TUBE HAVING REDUCED TUBE LENGTH

[75] Inventors: Keiichi Ohishi; Suenori Kimura, both of Hamamatsu, Japan

[73] Assignee: Hamamatsu Photonics K.K., Shizuoka, Japan

[21] Appl. No.: 818,282

[22] Filed: Jan. 9, 1992

[30] Foreign Application Priority Data

Jan. 14, 1991 [JP] Japan ..... 3-16066

[51] Int. Cl.[5] ..... H01J 31/48

[52] U.S. Cl. ..... 315/11; 313/105 R

[58] Field of Search ..... 315/11, 12.1; 313/103 R, 104, 105 R

[56] References Cited

U.S. PATENT DOCUMENTS

| | | | |
|---|---|---|---|
| 2,433,724 | 12/1947 | Wolfgang . | |
| 2,908,840 | 10/1959 | Anderson | 313/105 R |
| 3,875,441 | 4/1975 | Faulkner . | |
| 4,415,832 | 11/1983 | Faulkner et al. | 313/105 R |
| 5,061,875 | 10/1991 | Tomasetti et al. . | |

FOREIGN PATENT DOCUMENTS

| | | |
|---|---|---|
| 59-151741 | 8/1984 | Japan . |
| 59-167946 | 9/1984 | Japan . |
| 60-30063 | 7/1985 | Japan . |
| 2-227951 | 9/1990 | Japan . |

OTHER PUBLICATIONS

Patent Abstract of JP-A-59-108-254.

IEEE Transaction on Nuclear Science, vol. 33, No. 1, Feb. 1986, New York, pp. 364-369, Kume, et al., "Photomultiplier Tubes for BAF2/BGO Crystal Scintillators".

Patent Abstract of JP-A-59-221-960.

*Primary Examiner*—Theodore M. Blum

*Attorney, Agent, or Firm*—Sughrue, Mion, Zinn, Macpeak & Seas

[57] ABSTRACT

A photomultiplier tube includes a tube, a focussing electrode unit formed with a photoelectron transmission hole whose center is positioned offset from a central axis of the tube and a dynode positioned in confrontation with the transmission hole. A center of the dynode is also offset from the central axis of the tube. A grid type electrodes array are positioned at the same axial position of the dynode and positioned beside the dynode in a radial direction of the tube. The focussing electrode provides desirable uniformity in distribution of photoelectronics over the dynode even by the deviating position of the photoelectron transmission hole and the dynode. By positioning the dynode away from the central axis in the radial direction of the tube, the grid type electrode array can be positioned beside the dynode. Thus, entire length of the tube can be reduced without any change in a diameter of the tube because of the fact that a length of the dynode in the axial direction of the tube only influences the axial length of the tube.

8 Claims, 5 Drawing Sheets

PHOTOMULTIPLIER TUBE HAVING REDUCED TUBE LENGTH

BACKGROUND OF THE INVENTION

The present invention relates to a photomultiplier tube, and more particularly, to geometrical arrangement of an electrode structure of the photomultiplier tube for reducing a length of the tube.

In a photomultiplier tube, minute incident light is received on a photocathode, and photoelectron generated at the photocathode is multiplied through a secondary electron multiplier system for taking out an multiplied electric signal.

The photomultiplier tube is widely assembled and used in various radiation detectors and spectrometers such as a scintillation counter. In accordance with recent demand in down sizing of these detectors, a compact photomultiplier tube is required, particularly reduction in a tube length thereof is required.

A conventional box and grid combination type photomultiplier tube generally includes an outer tube or envelope in which provided are a photocathode, a first dynode, a focussing electrode, an anode, and a plurality of dynodes. Bundle of lights pass through substantially entire surface of the photocathode positioned at a head of the tube. The first dynode receives photoelectrons ejected from the photocathode, and a focussing electrode is adapted for converging the photoelectrons onto the first dynode. To this effect, the focussing electrode is formed with a transmission hole through which photoelectrons pass. Since the light bundles pass through substantially entire surface of the photocathode, the transmission hole and the first dynode are preferably be positioned at a central axis of the tube in order to effectively direct photoelectrons converted at photocathode toward the first dynode. The anode is disposed in a vicinity of a tube bottom, and the plurality of the dynodes are disposed between the first dynode and the anode and are arrayed approximately linearly in a lengthwise direction of the tube.

As described above, the focussing electrode is formed with the photoelectron transmission hole whose center is positioned coaxially with the central axis of the tube. Thus, according to the conventional box and grid combination type photomultiplier, large length of the photoelectron multiplier system, particularly, large length of the plurality of the dynode groups is provided in the axial direction of the tube, since these dynodes group must also be arrayed in the axial direction of the tube. Therefore, resultant tube length of the photomultiplier tube becomes large.

In order to overcome this problem, various proposals have been made for reducing the tube length. For example, a conventional photomultiplier tube is described in Japanese Patent Publication No. 60-30063 as shown in FIG. 1. According to the conventional example, there is provided a box and grid combination type photomultiplier tube which includes a photocathode 112, a focussing electrode 113 formed with a photoelectron transmission hole at a central portion thereof, a first box type dynode 114, grid type dynodes 117, 118, 119, 120 arrayed in a direction perpendicular to an axial direction of a tube 111 and positioned below the first box type dynode 114, and second and third box type dynodes 115 and 116 for directing and multiplying secondary electron from the first dynode 114 to the grid type dynodes 117 through 120. The second and third box type dynodes 115 and 116 are arrayed in the axial direction of the tube 111. More specifically, the second dyonode 115 is positioned beside the first dynode 114, and the third dynode 116 is positioned beside the grid type dynodes 117 through 120.

In this arrangement, the photoelectron transmission hole formed in the focussing electrode 114 has a center point coincident with a central axis of the tube 111, and a center of the first dynode 114 positioned below the transmission hole is also provided coaxially with the central axis of the tube in order to obtain sufficient converge of the electrons onto the dynode 114. On the other hand, the array of the grid type dynodes 117 through 120 is oriented in a direction perpendicular to the central axis of the tube.

In this photomultiplier tube, entire length of the dynodes in the axial direction of the tube is a sum of a lengths of the first dynode 114 and third dynode 116 or the grid type dynodes 117 through 120. Thus, entire axial length of the tube can be advantageously reduced, since the grid type dynodes array is not oriented in the axial direction of the tube but is oriented transversely relative to the tube axis.

SUMMARY OF THE INVENTION

The present inventors have been further engaged in R & D activities in order to further reduce the tube length. To be more specific, even by the disclosed device, resultant tube length is still large, since the grid type dynodes array is positioned below the first dynode 114, which still incurs increase in axial length of the tube. Here, it is impossible to reduce a distance between the photocathode 112 and the focussing electrode 113 in an attempt to reduce the axial length. This distance cannot be reduced in order to provide sufficient electrical field capable of sufficiently converging electrons onto a dynode positioned immediately downstream of the focussing electrode with respect to flowing direction of the electrons.

Accordingly, it is an object of the present invention to provide a photomultiplier tube capable of providing a minimized axial length of a tube.

In order to overcome the above described drawback, according to the present invention, a grid type dynode is disposed at the same axial position of a first stage dynode and at a position beside the first dynode. To realize this structure, a first dynode is positioned at a slightly deviating position relative to a center of a tube, and photoelectron transmission hole is correspondingly deviated from the tube center. Further, a focussing electrode is arranged so as to permit the photoelectrons emitted from a photocathode to pass through the deviating photoelectron transmission hole and to be uniformly directed to the first stage dynode.

That is, a photomultiplier tube of the present invention provides an outer tube, a photocathode a focussing electrode means, a first stage dynode and an array of electrodes (dynodes). The outer tube has a top end wall and defines a central axis. The photocathode is disposed in the outer tube and is provided at the top end wall for converting light into photoelectrons. The focussing electrode means is formed with a photoelectron transmission hole whose center is positioned at a position deviating from the central axis for deviating a locus of the photoelectrons emitted from the photocathode to permit the photoelectrons to pass through the photoelectron transmission hole. The first stage dynode has a center positioned at a position deviating from the central axis for alignment with the photoelectron transmission hole in order to receive the photoelectrons entered through the photoelectron transmission hole and converged by the focussing electrode. The first stage dynode emits secondary electrons. The array of electrodes is positioned beside the first stage dynode at a position diametrically opposite the first stage dynode for receiving the secondary electrons.

The photoelectron transmission hole is formed at a position deviated from the center axis of the tube, and the first stage dynode is disposed in confrontation with the photoelectron transmission hole. The focussing electrode is adapted for permitting photoelectrons emitted from the photocathode to pass through the photoelectron transmission hole and for converging the photoelectrons into the first stage dynode. Secondary electrons emitted from the first stage dynode enter into the grid type electrodes array which is positioned at the axial position the same as the first stage dynode. In the grid type dynode, the secondary electrons are multiplied to a desired multiplication rate.

An anode electrode can be positioned downstream of the electrodes array and at a position the same as the array. Through the anode electrode, electrical signal corresponding to the multiplied secondary electrons is outputted as a detection signal. With the arrangement, length of the entire dynode assembly in the axial direction of the tube is only restricted to the length of the first stage dynode.

DETAILED DESCRIPTION OF THE PREFERRED EMBODIMENT

A photomultiplier tube according to one embodiment of the present invention will be described with reference to FIGS. 2 through 9(*b*).

Figure 1:
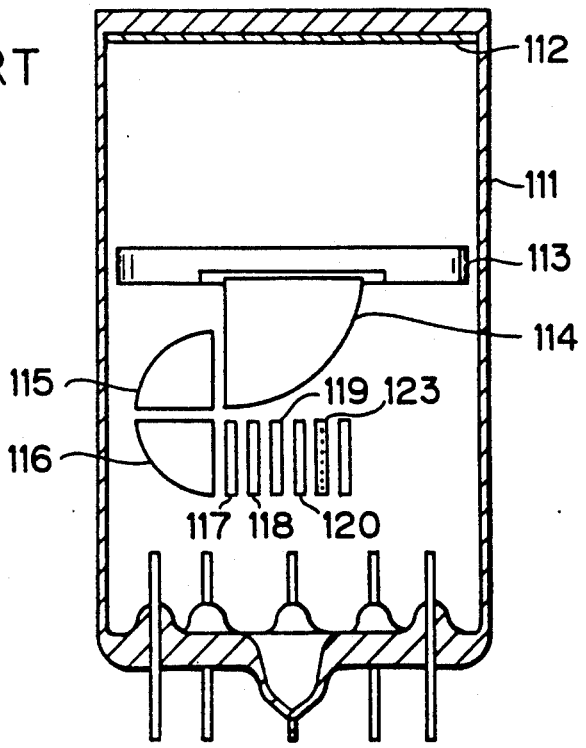
FIG. 1 PRIOR ART
FIG. 1 is a cross-sectional view showing a conventional photomultiplier tube.
Figure 2:
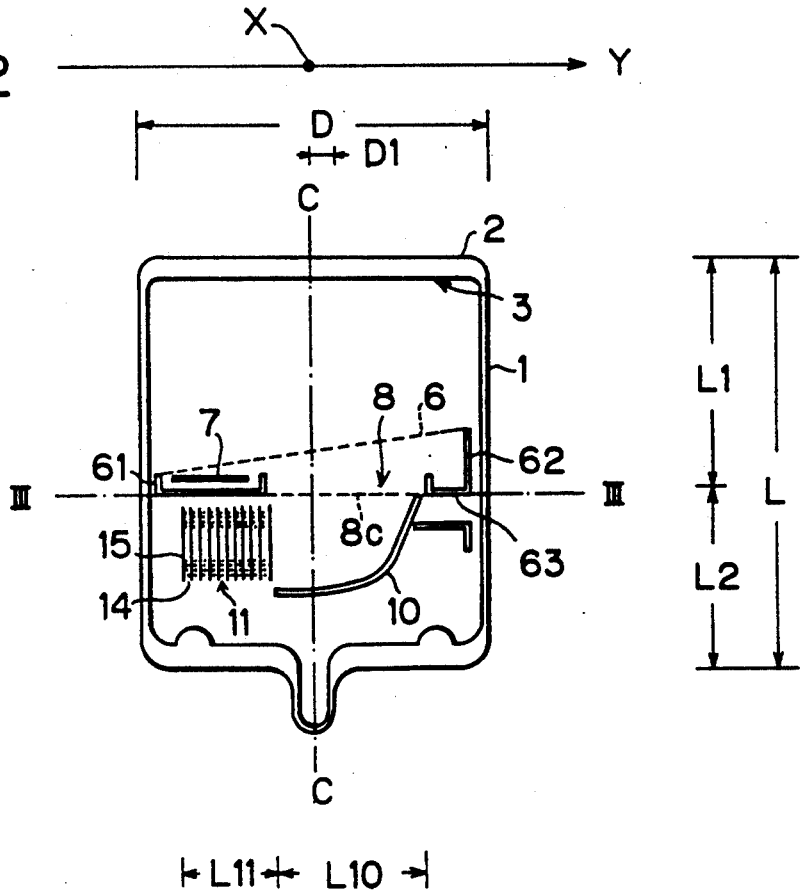
FIG. 2 is a cross-sectional view showing a photomultiplier tube according to one embodiment of the present invention.
Figure 3:
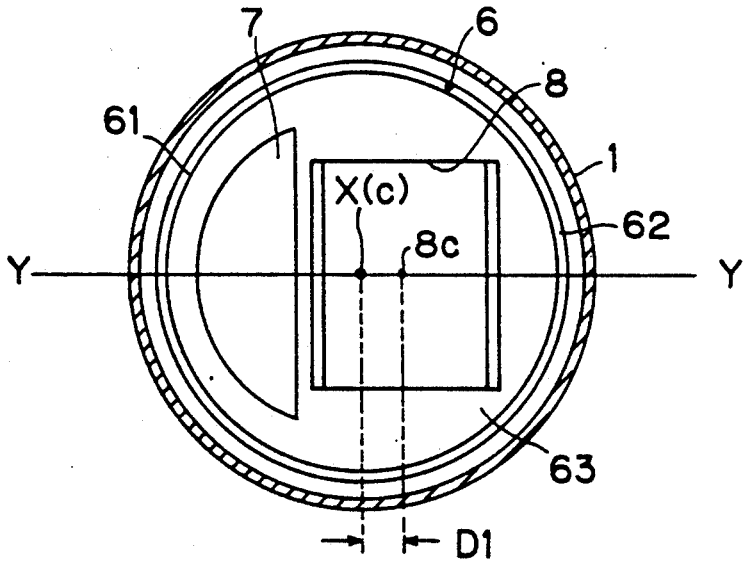
FIG. 3 is a cross-sectional plan view taken along a line III—III in FIG. 2.

In FIGS. 2 and 3, the photomultiplier tube includes an outer tube or envelope 1 formed of a glass 1 and having a central axis C. Within the outer envelope 1, are disposed a photocathode 3, a main focussing electrode 6, an auxiliary focussing electrode 7, a box type dynode 10, a grid type electrodes group 11, an anode electrode 14, and a plate like dynode 15. A head portion of the outer envelope 1 is sealed by a light receiving wall 2, and a bottom of the envelope is hermetically sealed after evacuation.

The photocathode 3 is positioned at the inner head portion of the tube 1 for converting light irradiated onto the surface of the photocathode 3 into photoelectrons.

The main focussing electrode 6 is best shown in FIGS. 2 and 3. In contrast to the conventional focussing electrode, the main focussing electrode 6 has a bottom portion 63 where a photoelectron transmission hole 8 is formed at a position offset from a central axis C of the tube 1. That is, a center of the hole 8 is deviated from the central axis C by a distance D1. With this arrangement, a difficulty may be expected in electron focussing ability onto the first or front dynode 10. To solve this drawback, the main focussing electrode 6 has an improved configuration so as to provide an improved electric field in order to pass all electrons from the photocathode 3 through the transmission hole 8 and to direct all the electrons onto the first dynode 10.

To be more specific, the main focusing electrode 6 has a tubular shape, and has a top open end portion facing with the photocathode 3 so as to receive photoelectrons from the photocathode 3. An axis of the focussing electrode 6 is directed in parallel with the central tube axis C. A contour of the top open end is defined by a top edge of a high wall portion 62 and a low wall portion 61 contiguous with the high wall portion 62 so as to provide a predetermined electric field, to thereby direct the electrons toward the transmission hole 8. In the illustrated embodiment, the main focusing electrode 6 has a cylindrical shape having a slant head portion to provide the low wall area 61 and the high wall area 62. The high wall portion 62 is positioned at a deviating direction of the transmission hole 8. In FIG. 2, the top edge contour of the electrode 6 obliquely extends relative to a line perpendicular to the central axis C.

Within the main focussing electrode 6, the auxiliary focussing electrode 7 is disposed at a side of the low wall portion and on the bottom portion 63 of the main focussing electrode 6. The auxiliary focusing electrode 7 is adapted for promoting the deviation of the electron flowlines so as to permit all electrons from the photocathode 3 to pass through the transmission hole 8. That is, the auxiliary focussing electrode 7 provide repulsive force against the electron which may direct to a direction away from the transmission hole 8, (toward the low wall portion), so that such electron can be directed toward the transmission hole 8. In the illustrated embodiment, the auxiliary focussing electrode 7 has a semicircular shape. That is, by the combination of the main and the auxiliary focussing electrodes 6 and 7, equipotential lines shown in FIG. 7 can be provided, so that electrons from the photocathode 3 can be flowed along the electric field vectors shown in FIG. 8. As a result, even if the transmission hole 8 is positioned offset from the central axis of the tube 1, the substantially all electrons can passes through the hole 8.

Figure 4:
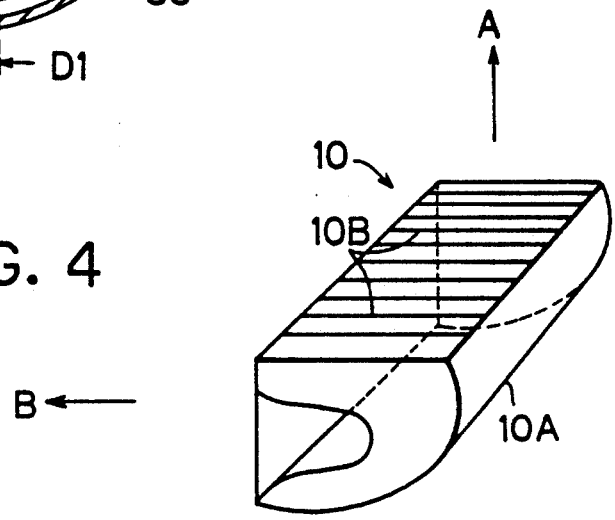
FIG. 4 is a perspective view showing a box type dynode (first dynode) shown in FIG. 2.

The box type dynode 10 serving as a front or a first stage dynode is shown in FIGS. 2 and 4. The box type dynode 10 is positioned immediately below the focussing electrode 6. That is, the box type dynode 10 has a photoelectron receiving face 10A which confronts the photoelectron transmission hole 8. Further, a size of the photoelectron receiving face 10A is approximately the same as a size of the photoelectron transmission hole 8.

Therefore, a center of the photoelectron receiving face 10A of the box dynode 10 is also deviated from the central axis C—C of the tube by the distance D1. The box type dynode 10 has a surface facing with the photoelectron transmission hole 8. The surface is provided with mesh lines 10B extending in a direction perpendicular to the photoelectron advancing direction so as to provide equipotential. The photoelectron receiving surface 10A is formed with a secondary electron emitting surface made of, for example, antimony and alkali metal. In the illustrated embodiment, the first dynode has a quadrant cross-section as best shown in FIG. 4.

If photoelectrons passing through the photoelectron transmission hole 8 are directed in a direction indicated by an arrow A (axial direction C of the tube 1) and are impinged on the photoelectron receiving face 10A, secondary electrons are emitted and are directed in a direction indicated by an arrow B (a direction perpendicular to the axial direction C). The above described grid type electrode group 11, the anode electrode 14 and the plate like dynode 15 are arrayed in the direction B.

Figure 5:
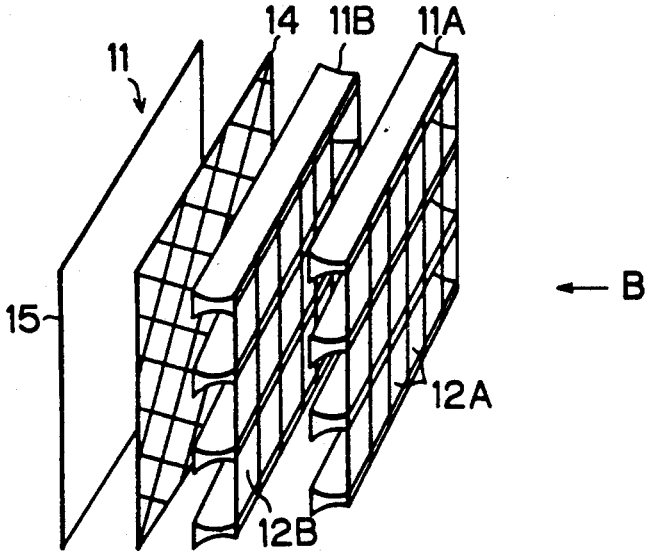
FIG. 5 is a schematic perspective view showing grid type electrodes group, an anode electrode and a plate like dynode those shown in FIG. 2.
Figure 6:
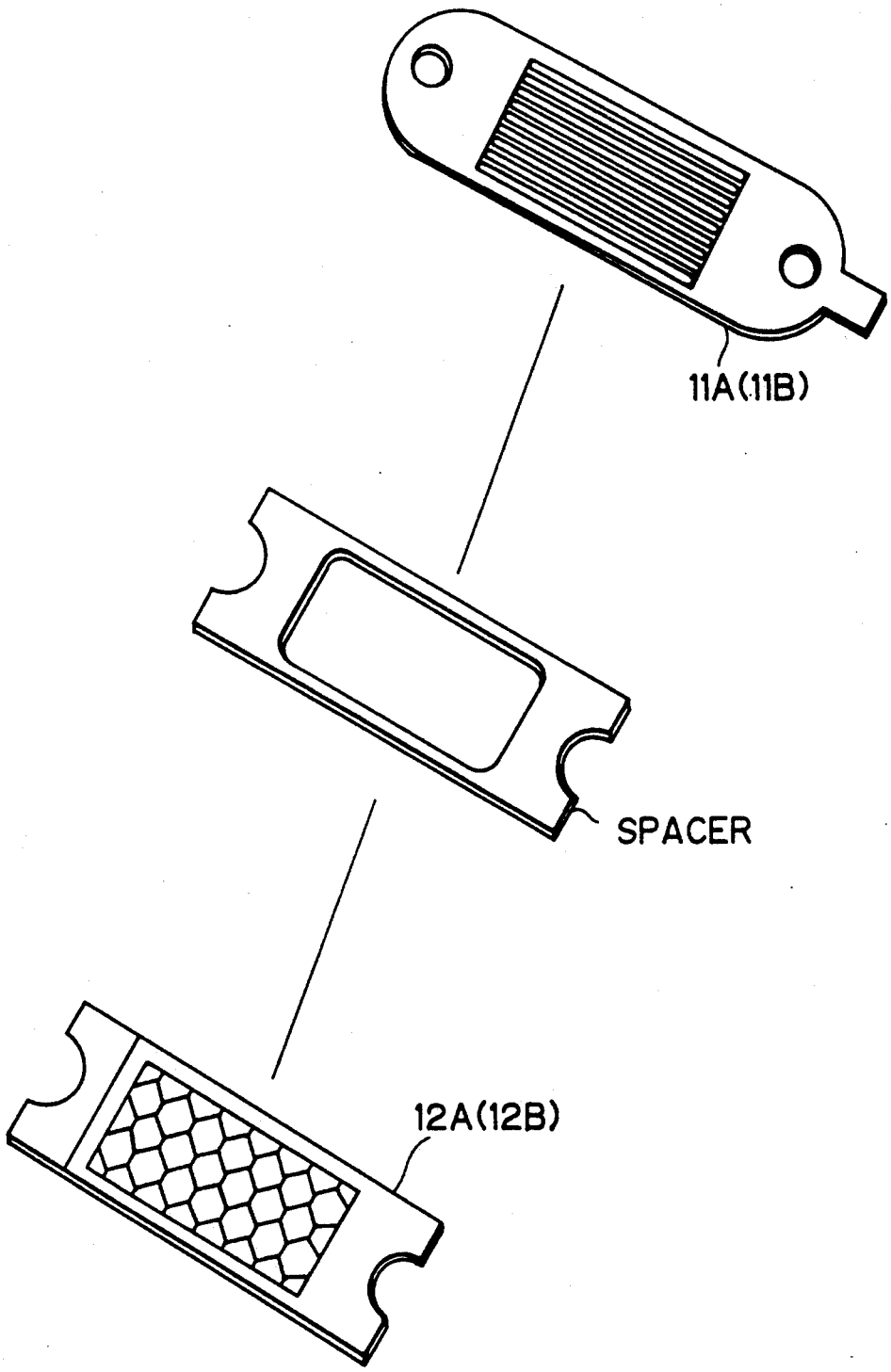
FIG. 6 is an exploded perspective view showing grid type electrodes group according to the one embodiment of this invention.
Figure 7:
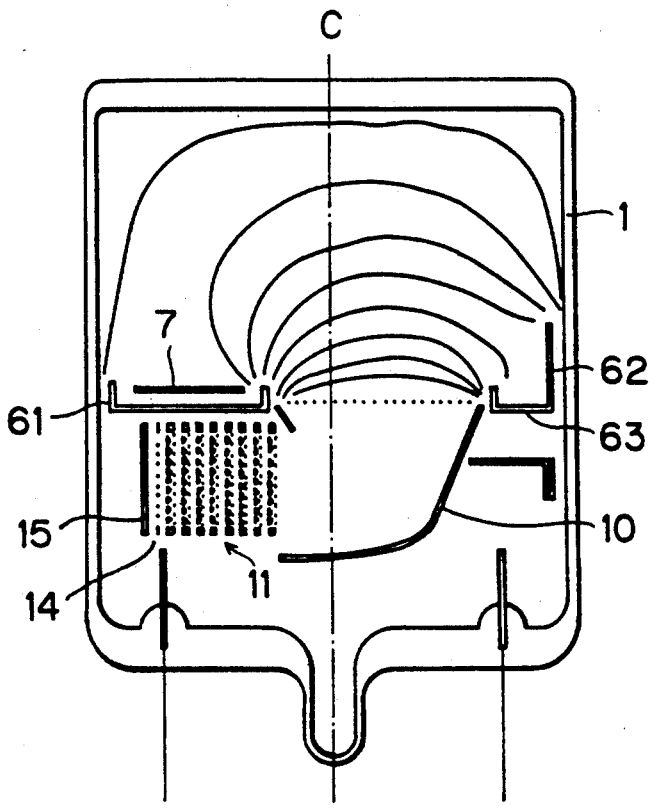
FIG. 7 is a cross-sectional view for description of equi-potential lines defined by focussing electrodes according to the one embodiment of this invention.
Figure 8:
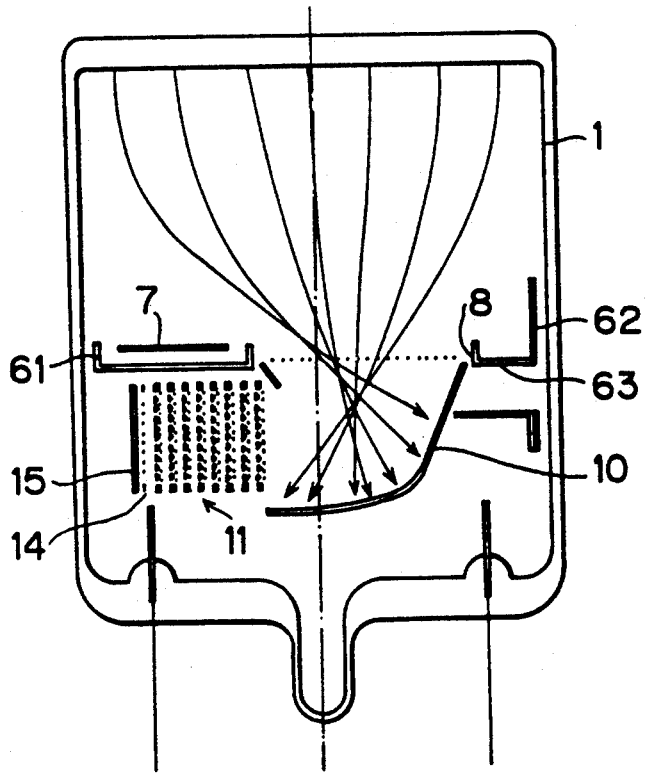
FIG. 8 is a cross-sectional view for description of deviation of electron flowlines according to the one embodiment of this invention.

Most importantly, an array of the grid type electrode group 11, the anode electrode 14 and the plate like dynode 15 are shown in FIGS. 2, 5 and 6. As best shown in FIG. 2, the array can be positioned at a lateral space positioned beside the first dynode 10, since the deviating arrangement of the first dynode 10 can provide such space. More specifically, the array can be positioned at the same axial position relative to the first dynode 10 but positioned different therefrom in radial or diametrical direction of the tube 1 for reducing resultant axial length of the tube.

In FIGS. 5 and 6, the grid type electrode group 11 includes two sets of electrodes, i.e., a first set of grid type electrodes 11A and a second set of grid type electrodes 11B. However, necessary numbers of sets are provided in accordance with an intended photomultiplication rate.

A plurality of electrode rods each having a generally triangular cross-section are directed in parallel to one another in the first set of the grid type electrodes 11A. Further, a plurality of first mesh electrodes 12A are disposed on upstream side of the parallel arrayed electrode rods of the first set 11A in a direction perpendicular to the extending direction of the electrode rods. The parallel arrayed electrode rods and the first mesh electrodes 12A define in combination a grid configuration. The first mesh electrode 12A is adapted for providing equipotential extending perpendicular to a direction of the secondary electrons entering into the electrode rods. The second set of the grid type electrodes 11B has a configuration identical with that of the first set of grid type electrodes 11A.

In the depicted embodiment, grid hoes of the first and the second sets of the grid type electrodes 11A and 11B are aligned with each other. Each hillsides of the first set of grid type electrodes 11A at which the secondary electrons are impinged are formed of secondary electron emitting surfaces made of, for example, antimony and alkali metal. The hillsides portions or the secondary electron emitting surfaces emit the secondary electrons which are then impinged on secondary electron emitting surfaces at each hillsides of the second grid type electrodes 11B. Thus, the plurality of the grid type electrodes arranged in series can provide a function similar to that of dynodes of the second and of subsequent stages in the conventional box and grid combination type photomultiplier tube. Accordingly, a photomultiplication system having the secondary electron multiplication function the same as that of the plural stages of the box type dynodes can be provided with a minimized distance in the axial direction of the tube.

The anode electrode 14 is disposed at a rear side (downstream side) of the second set of the grid type electrodes 11B, and the dynode 15 is disposed at a rear side of the anode electrode 14. The anode electrode 14 is of mesh form, and the dynode 15 is of plate like form.

Potential applying condition with respect to the above described electrodes will next be described.

The photocathode 3 has the lowest potential (grounded), and the applied potential will be increased, in order from the auxiliary focussing electrode 7, the main focussing electrode 6, the box type dynode 10, the grid type electrode group 11, the plate like dynode 15 and the anode electrode 14.

Voltage level V7 applied to the auxiliary focussing electrode 7 may be equal to that applied to the photocathode 3. However, more preferably, a voltage level V7 is higher than a voltage level V3 applied to the photocathode 3, and is lower than a voltage level V6 applied to the main focussing electrode 6. That is, the voltage level V7 applied to the auxiliary focussing electrode V7 is between the voltage level V3 applied to the photocathode 3 and the voltage level V6 applied to the main focussing electrode 6. With these voltage levels, stabilized and asymmetrical flowlines of photoelectrons can be provided, that is, photoelectrons emitted from the surface of photocathode 3 can be stably passed through the photoelectron transmission hole 8, and can be stably and uniformly converged onto the photoelectron receiving face 10A of the box type dynode 10.

With the arrangement of the main and auxiliary focussing electrodes 6 and 7 under the above described voltage applying conditions, photoelectrons emitted from the photocathode 3 can be passed through the photoelectron transmission hole 8 formed at a position deviating from a central axis C of the tube 1, and can be uniformly converged onto the photoelectron receiving face 10A of the box type dynode 10. In other words, the main focussing electrode 6 is adapted to create a predetermined electric field capable of directing the photoelectrons from the photocathode toward the transmission hole 8, and the auxiliary focussing electrode 7 is adapted for ensuring the maintenance of given flowlines of photoelectrons. The auxiliary focussing electrode 7 can further lower potential at the low wall side 61 in order to surely direct the photoelectrons located at a position immediately above the low wall portion 61 and the auxiliary focussing electrode 7. Therefore, even by the deviating arrangement of the photoelectron transmission hole 8, the first dynode 10 can provide uniformity in distribution of the impinged photoelectrons over an entire area thereof.

In other words, by the geometrical arrangement of the main and auxiliary focussing electrodes 6 and 7, the photoelectron transmission hole 8 and the box type dynode 10 can be positioned at a deviating position from the central axis C of the tube 1 by the distance D1. As a result, a sufficient space can be provided in the radial direction at a position beside the box type dynode 10 even if the outer diameter of the tube is equal to that of the conventional tube. Thus, the grid type electrode group 11, the anode electrode 14 and the plate like dynode 15 such as those shown in FIG. 5 can be positioned at a newly created space as shown in FIG. 2 at an axial position of the tube the same as that of the box type dynode 10. In this case, the box type dynode 10 has the largest length in the axial direction of the tube. Therefore, the above described electrodes are all accommodated into the space within the profile of the box type dynode 10 in the axial direction of the tube. Distance between the photocathode 3 and the photoelectron transmission hole 8 is the same as the conventional distance to produce sufficient electrical field as described above. Therefore, the photomultiplier in accordance with the present embodiment can provide a reduced tube length, since the distance between the photoelectron transmission hole 8 and the bottom of the glass envelope 1 can be reduced.

Comparative examples will be described showing various dimensions of a conventional photomultiplier tube and a photomultiplier tube of the present embodiment.

| | Conventional tube (mm) | Present tube (mm) |
|---|---|---|
| Tube Diameter: D | 50.8 | 50.8 |
| Photoelectron Converging Distance: L1 | 32.0 | 32.0 |
| Length of Electrode in Axial Direction: L2 | 45.0 | 29.0 |
| Tube Length: L | 77.0 | 61.0 |

In this example, the length L2 of the electrodes in the axial direction of the tube can be reduced by 16.0 mm, and entire tube length L can be correspondingly reduced. Incidentally, in this example, 5 mm was provided as deviating distance D1 of the photoelectron transmission hole 8 and the box type dynode 10. The deviation distance was measured from the central axis C of the tube to the center point 8C of the photoelectron transmission hole 8 or the photoelectron receiving face 10A of the box type dynode 10. Further, length L10 of the box type dynode 10 in the radial direction of the tube was 20 mm, and length L11 starting from the grid type electrode group 11 and ending at the plate like dynode 15 in the radial direction of the tube was approximately 15 mm.

Figure 9A:
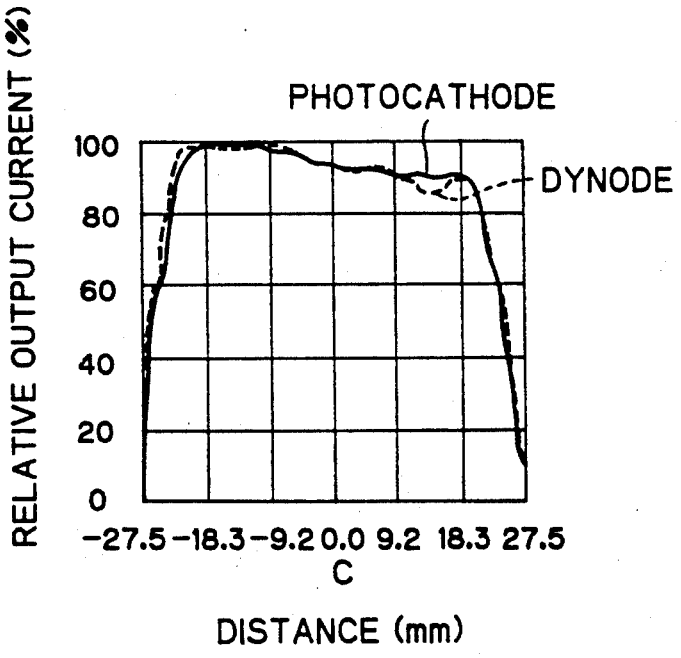
FIGS. 9(*a*) and 9(*b*) are views illustrating uniformity in distribution of electrons at a photocathode and the first dynode according to the one embodiment of the present invention.
Figure 9B:
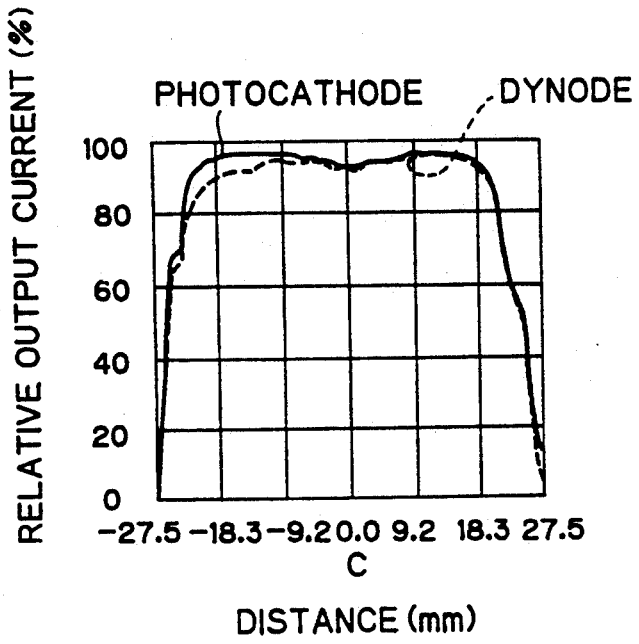

Test results will be described with respect to uniformity in photoelectron distribution over the photocathode and the dynode 10 in accordance with the present embodiment. FIGS. 9(*a*) and 9(*b*) respectively show uniformity in distribution of photoelectrons at the photocathode 3 (solid line) and the dynode 10 (broken line) along X axis and Y axis, respectively. The directions of X and Y are also shown in FIG. 2. The Y axis extends on a diameter of the tube 1 and across a center of the auxiliary focussing electrode 7 and the center of the transmission hole 8. The X axis extends perpendicular to the Y axis as shown, and the uniformity was tested on the X and Y axes, respectively.

An abscissa of a graph of FIG. 9(*a*) corresponds to X-axis shown in FIG. 2. In the abscissa, the tube center C is defined as 0.0 mm, and positive and negative distances (mm) were plotted in radially opposite directions with respect to the tube center. Relative output current (%) is plotted in ordinate of FIG. 9(*a*). Further, an absiccsa of a graph of FIG. 9(*b*) corresponds to Y-axis shown in FIG. 2. In the abscissa of FIG. 9(*b*), the tube center C is defined as 0.0 mm, and positive and negative distance (mm) were plotted thereon. Relative output current (%) is plotted in ordinate of FIG. 9(*b*). In this measurement, the photomultiplier tube having a diameter of 55 mm was used. Applied voltage was 1000 V, and wavelength of a light incident into the photocathode was 420 nm.

As is apparent from the test results shown in FIGS. 9(*a*) and 9(*b*), uniformity in electron distribution along entire area of the dynode 10 was obtained in the present embodiment. In other words, desirable uniformity can be obtained even if the photoelectron transmission hole 8 is deviated from the central axis C of the tube.

While the invention has been described in a specific embodiment thereof, it would be apparent to those skilled in the art that various changes and modifications may be made without departing from the spirit and scope of the invention. For example, the outer tube or envelope 1 can have polygonal cross section instead of a circular cross-section. Further, main and auxiliary focussing electrode pair other than those of the above described cylindrical slant head focussing electrode 6 and the semicircular focussing electrode 7 can be used. For instance, if the outer tube having the polygonal cross-section is used, the outer peripheral contour of the main focussing electrode can have the similar correspondence. Further, it would be also possible to provide a cylindrical focussing electrode within the polygonal outer envelope.

In the illustrated embodiment, the auxiliary electrode 7 is oriented in parallel with the bottom portion 63 of the main focussing electrode 6, and the electrode 7 has a flat semicircular plate shape positioned adjacent the low wall portion 61. However, instead of the flat plate, mesh like electrode is available as the auxiliary focussing electrode. Further, the electrode 7 can be oriented in a slanting fashion relative to the bottom portion of the main focussing electrode 6. Reversely, various shape of the main focussing electrode 6 can be conceived in accordance with the variation of the auxiliary focussing electrode 7. In summary, the main focussing electrode 6 and the auxiliary focussing electrode 7 are adapted for permitting electrons to pass through the photoelectron transmission hole 8 positioned offset from the central axis of the tube, and for uniformly converging the photoelectrons onto the box type dynode 10 which is also deviated from the central axis. In this standpoint, the focussing electrodes 6 and 7 can have various structure.

Similarly, various modifications may be available regarding the box type dynodes 10 and the grid type electrode group 11. Since these dynode serve to provide photomultiplication function in cooperation with one another, these dynodes are not limited to the illustrated configuration so far as these dynodes can provide directing or deviating relationship to one another for the secondary electrons and can provide predetermined photomultiplication rate.

In the photomultiplier tube shown in FIG. 2, an area of the photocathode 3 is approximately equal to an area of the bottom portion 63 of the main focussing electrode 6. However, it goes without saying that the present invention is applicable to a photomultiplier tube in which the photocathode 3 has an area larger than the bottom portion so as to receive greater amount of incident light. Of course, in this case, shapes of the main and auxiliary focussing electrode 6 and 7 must be modified, since different locus of the photoelectrons may be provided.

As described above according to the present invention, dynode accommodation space can be created at a position laterally beside the first dynode by deviatingly positioning the first dynode and the photoelectron transmission hole. Therefore, tube length of the photomultiplier tube can be reduced while maintaining performance by disposing the array of the grid type electrodes group in the accommodation space, the array extending in the radial direction of the tube.

What is claimed is:

1. A photomultiplier tube comprising:

an outer tube having a top end wall and defining a central axis;

a photocathode disposed in the outer tube and provided at the top end wall for converting light into photoelectrons;

a focussing electrode means formed with a photoelectron transmission hole whose center is positioned at a position deviating from the central axis for deviating a locus of the photoelectrons emitted from the photocathode to permit the photoelectrons to pass through the photoelectron transmission hole;

a first stage dynode whose center is positioned at a position deviating from the central axis for alignment with the photoelectron transmission hole in order to receive the photoelectrons entered through the photoelectron transmission hole and converged by the focussing electrode, and in order to emit secondary electrons; and an array of electrodes positioned beside the first stage dynode at a position diametrically opposite the first stage dynode for receiving the secondary electrons.

2. The photomultiplier tube according to claim 1 wherein the focussing electrode comprises:

a main focussing electrode having a tubular shape for providing an electrical field capable of directing the photoelectrons toward the transmission hole; and an auxiliary focussing electrode positioned within the main focussing electrode and at a position opposite said position of the transmission hole deviating from said central axis for promoting orientation of the photoelectrons toward the transmission hole.

3. The photomultiplier tube according to claim 2, wherein the main focussing electrode is of tubular shape having a tubular wall and a bottom wall, the tubular wall comprising a high wall portion positioned near said position of the transmission hole deviating from said central axis and a low wall portion contiguous with the high wall portion and at a position opposite said position of the transmission hole deviating from said central axis, a contour of an edgeline of the high and low wall portions providing a front open end which is obliquely directed with respect to a line perpendicular to the central axis, the photoelectron transmission hole being formed at the bottom wall.

4. The photomultiplier tube according to claim 3, wherein the auxiliary focusing electrode has a semicircular shape and positioned adjacent the low all portion.

5. The photomultiplier tube according to claim 2, wherein the array of electrodes comprises a plurality of sets of grid type electrodes, each set having a plurality of electrode rods extending in parallel to one another.

6. The photomultiplier tube according to claim 2, wherein the array of electrodes comprises a plurality of sets of mesh type electrodes.

7. The photomultiplier tube according to claim 2, wherein the first stage dynode has a quadrant-shaped cross-section.

8. The photomultiplier tube according to claim 2, wherein the photocathode is applied with a lowest potential relative to the auxiliary focussing electrode and the main focussing electrode, and the auxiliary focussing electrode and the main focussing electrode are applied with a first and a second potential, the first potential being lower than the second potential.

* * * * *